US011597576B2

(12) United States Patent
Scribner et al.

(10) Patent No.: US 11,597,576 B2
(45) Date of Patent: Mar. 7, 2023

(54) PACKAGING FOR PRESSURE AND GAS SENSITIVE PRODUCTS

(71) Applicant: RESPIROGEN, INC., Boulder, CO (US)

(72) Inventors: Robert T Scribner, Boulder, CO (US); Paul A Mountford, Boulder, CO (US); Robert M Scribner, Longmont, CO (US)

(73) Assignee: RESPIROGEN, INC., Boulder, CO (US)

( * ) Notice: Subject to any disclaimer, the term of this patent is extended or adjusted under 35 U.S.C. 154(b) by 39 days.

(21) Appl. No.: 17/178,238

(22) Filed: Feb. 17, 2021

(65) Prior Publication Data

US 2021/0253326 A1 Aug. 19, 2021

Related U.S. Application Data

(60) Provisional application No. 62/977,887, filed on Feb. 18, 2020.

(51) Int. Cl.

| | |
|---|---|
| ***B65D 81/02*** | (2006.01) |
| ***B65D 81/03*** | (2006.01) |
| ***B65D 77/06*** | (2006.01) |
| ***B65D 81/20*** | (2006.01) |

(52) U.S. Cl.

CPC ..... *B65D 81/03* (2013.01); *B65D 77/06* (2013.01); *B65D 81/2015* (2013.01)

(58) Field of Classification Search

CPC ..... B65D 77/06; B65D 81/03; B65D 81/07; B65D 81/2015; B65B 7/16

USPC ..... 206/438, 521, 583; 53/425, 469

See application file for complete search history.

(56) References Cited

U.S. PATENT DOCUMENTS

| | | | | |
|---|---|---|---|---|
| 2,785,795 A * | 3/1957 | Ryno | B65D 81/07 | 206/466 |
| 4,013,170 A * | 3/1977 | Hutterer | B65D 81/07 | 206/583 |
| 4,267,684 A * | 5/1981 | Ambrose | B65B 23/00 | 53/472 |
| 5,901,852 A * | 5/1999 | Simpson | B65D 5/029 | 206/583 |
| 6,880,706 B2 * | 4/2005 | Braconnot | B65D 81/07 | 206/583 |
| 2016/0137384 A1 * | 5/2016 | Buelna | B65D 81/07 | 206/583 |

* cited by examiner

*Primary Examiner* — Luan K Bui

(74) *Attorney, Agent, or Firm* — Brainspark Associates, LLC

(57) ABSTRACT

Disclosed are improved devices, systems and methods for storing, protecting and/or dispensing/delivering products that are particularly sensitive to pressure changes, alterations in gas distributions and/or partial pressures, physical impacts, temperature changes and/or other variations in the ambient environment.

20 Claims, 11 Drawing Sheets

PACKAGING FOR PRESSURE AND GAS SENSITIVE PRODUCTS

CROSS-REFERENCE TO RELATED APPLICATIONS

This application claims the benefit of U.S. Provisional Patent Application Ser. No. 62/977,887 entitled "Method for Packaging Pressure and Gas Sensitive Products," filed Feb. 18, 2020, the disclosure of which is incorporated by reference herein in its entirety.

TECHNICAL FIELD

The invention relates to improved devices, systems and methods for packaging, storing and dispensing/delivering products that are particularly sensitive to pressure changes, alterations in gas distributions and/or partial pressures, physical impacts, temperature changes and/or other variations in the ambient environment. More specifically, disclosed are a variety of systems for storing and/or dispensing compounds, including compounds comprising microbubble carriers, that desirably enable and/or facilitate the transport of oxygen and/or other therapeutic substances into a human or mammalian body to desirably enable various metabolic processes.

BACKGROUND OF THE INVENTION

Oxygen is one of the basic essentials for sustaining life and comprises approximately 20.95% of dry atmospheric air. While humans and other mammals are capable of passively absorbing some levels of oxygen directly from the atmosphere (via upper layer skin cells and the cells in the front surface of the eyes, for example), human and/or mammalian bodies have a huge demand for oxygen, and thus their need for lungs which actively pull in oxygen and transfer it to the blood, allowing the body to transport oxygen to various cells throughout the body.

Recently, methods of providing oxygenation to various anatomical structures utilizing pathways other than via the lungs have been proposed, including in U.S. Pat. Nos. 10,124,126 and 10,058,837 and others. Many of these approaches utilize microbubbles containing oxygen and/or other substances (including oxygen microbubbles or OMBs), which can be introduced into and/or can contact various anatomical structures, and which promote oxygen and/or carbon dioxide exchange (and/or flow of other nutrients and/or wastes) into and/or out of the anatomical structures and/or surfaces thereof. The oxygen microbubble (OMB) carrier may comprise oxygen gas filled bubbles having a shell composed of an amphiphilic surfactant phospholipid monolayer or cross-linked polymers or a combination of phospholipids and polymers, and may include other substances to enable and/or facilitate transfer of gases and/or other compounds into and/or out of the microbubbles. In various embodiments, the amphiphilic phospholipid monolayer shell variation of an exemplary OMB embodiment can have similar composition to lung surfactant and may require comparable physical properties, such as rapid adsorption to and mechanical stabilization of the gas/liquid interface and high gas permeability. Thus, OMBs can be designed to mimic the mechanical and gas transport properties of the alveolus to deliver the oxygen payload. By transport into and/or through the other anatomical structures, phospholipid monolayer, cross-linked polymer or mixed phospholipid-polymeric stabilized OMBs will desirably provide oxygen for uptake through tissue surfaces to underlying tissue layers and/or even to the bloodstream for transfer to more remote regions of the patient's body.

Unfortunately, microbubbles can often be relatively "fragile" structures that can "degrade" and/or assume various undesirable properties after manufacture, such as a tendency of some microbubbles to "pop" or "destruct" by experiencing a breakdown of the microbubble shell—typically in response to shear forces. Alternatively, individual microbubbles may coalesce together, some may reduce in size to become smaller microbubbles, and others may increase in size via absorption and/or incorporation of other substances, including oxygen obtained from other microbubbles. Microbubbles may also "destruct" or otherwise alter in size and/or shape through the absorption of the lipid shell, causing the microbubbles to break down and/or release the gaseous contents such as oxygen or other gases. Microbubbles can even degrade due to the effects of changing temperatures, natural or atmospheric pressure changes, and even changes in the humidity levels of the surrounding environment.

Large volume, sterile liquid products for medical use are generally produced on highly automated production lines to allow for economies of scale, as well as to aid in maintaining cleanliness and sterility, as human input is often the largest source of contamination during production. In many cases, the products must then be packaged and shipped to point-of-use locations such as clinics and hospitals. However, large volume, sterile products such as intravenous (IV) solutions are commonly supplied in plastic containers, which are generally not suitable for packaging of more fragile or delicate items such as microbubble products including phospholipid gas spheres. These containers are typically gas permeable and over time will allow specific gas concentrations in the product to equilibrate with the ambient atmosphere. Additionally, such non-rigid containers typically do not provide adequate protection from pressure changes through either atmospheric pressure changes or physical compression of the container, which pressure changes can lead to significant degradation of the microbubbles and/or their payloads.

In many cases, it would be desirous to be able to manufacture and store microbubbles containing gases, such as oxygen, for extended periods of time without significant degradation of the microbubbles. Moreover, it would be advantageous to transport such microbubble carriers and be able to dispense and/or distributer the microbubbles with a minimum of handling and/or transference between multiple containers.

BRIEF SUMMARY OF THE INVENTION

The present invention includes the realization of a need for microbubble storage, transport and/or delivery systems, devices, techniques and/or methods that can facilitate a relatively long-term storage of microbubble formulations yet allow for ease of transport and/or delivery/use of such microbubbles under a variety of conditions.

In various exemplary embodiments, storage systems and devices are provided that can be utilized to store microbubbles for extended periods of time, and in various instances the storage system component can easily transported and/or utilized to dispense and/or otherwise use the microbubbles in a desired manner. In some embodiments, the systems and/or devices can be utilized with compounds including microbubbles containing oxygen and/or other substances (including oxygen microbubbles or OMBs). The oxygen microbubble (OMB) carrier may comprise oxygen gas filled bubbles having a shell composed of an amphiphilic surfactant phospholipid monolayer or cross-linked polymers or a combination of phospholipids and polymers, and may include other substances to enable and/or facilitate transfer of gases and/or other compounds into and/or out of the microbubbles. If desired, the compounds may include various other constituents that may limit degradation and/or promote stability of the microbubbles under a variety of conditions.

In various embodiments, the disclosed storage systems and devices will desirably be capable of maintaining a sterile or biologically inert environment within all or some portion of the systems, devices and/or components thereof. For example, where microbubbles are utilized in the various treatments disclosed in U.S. Pat. Nos. 10,124,126 and 10,058,837, the disclosures of which are incorporated by reference herein in their entireties, the dispensing of sterile and/or pyrogenically non-reactive microbubbles may be particularly desirable, especially in environments where maintaining sterility is difficult and/or impossible, such as within battlefield environments, during natural or manmade disasters, and/or during search and rescue operations.

In some embodiments, the OMBs may be dispensed and/or delivered to an anatomical location of a human or mammalian body to desirably deliver oxygen to one or more specific locations of the body, and such delivery of oxygen and/or other compounds may occur at multiple individual locations and/or along an entirety of an applied surface of external and/or internal anatomy of a patient and/or various portions thereof.

The container of the present invention will desirably allow pressure and gas sensitive products such as microbubbles to be produced within large-scale and/or existing production facilities, and further desirably permit packaging and storage of these products using sterile inner packaging in combination with a rigid, gas tight outer container. Moreover, the present invention desirably facilitates dispensing and/or use of the microbubbles with little need for ancillary devices, especially in times of emergency treatment where additional medical equipment may be unavailable, In contrast to many large volume liquid medical products, which can be administered from the packaging using a passive gravity drip, the components of the present invention desirable include hand powered, mechanical or pneumatic pumping mechanisms formed integrally with the container to provide an active delivery method, which not only allows their use under adverse conditions, but also prevents a hospital or medical facility from having to purchase, store and maintain additional pumping or other equipment. Including the dispensing components and/or accessories as part of the packaging components, and especially where such components are contained inside the outer container, means that everything required for administration of the microbubble product is contained in a single place for immediate use and for transfer to a sterile surgical field.

DETAILED DESCRIPTION OF THE INVENTION

Figure 1:
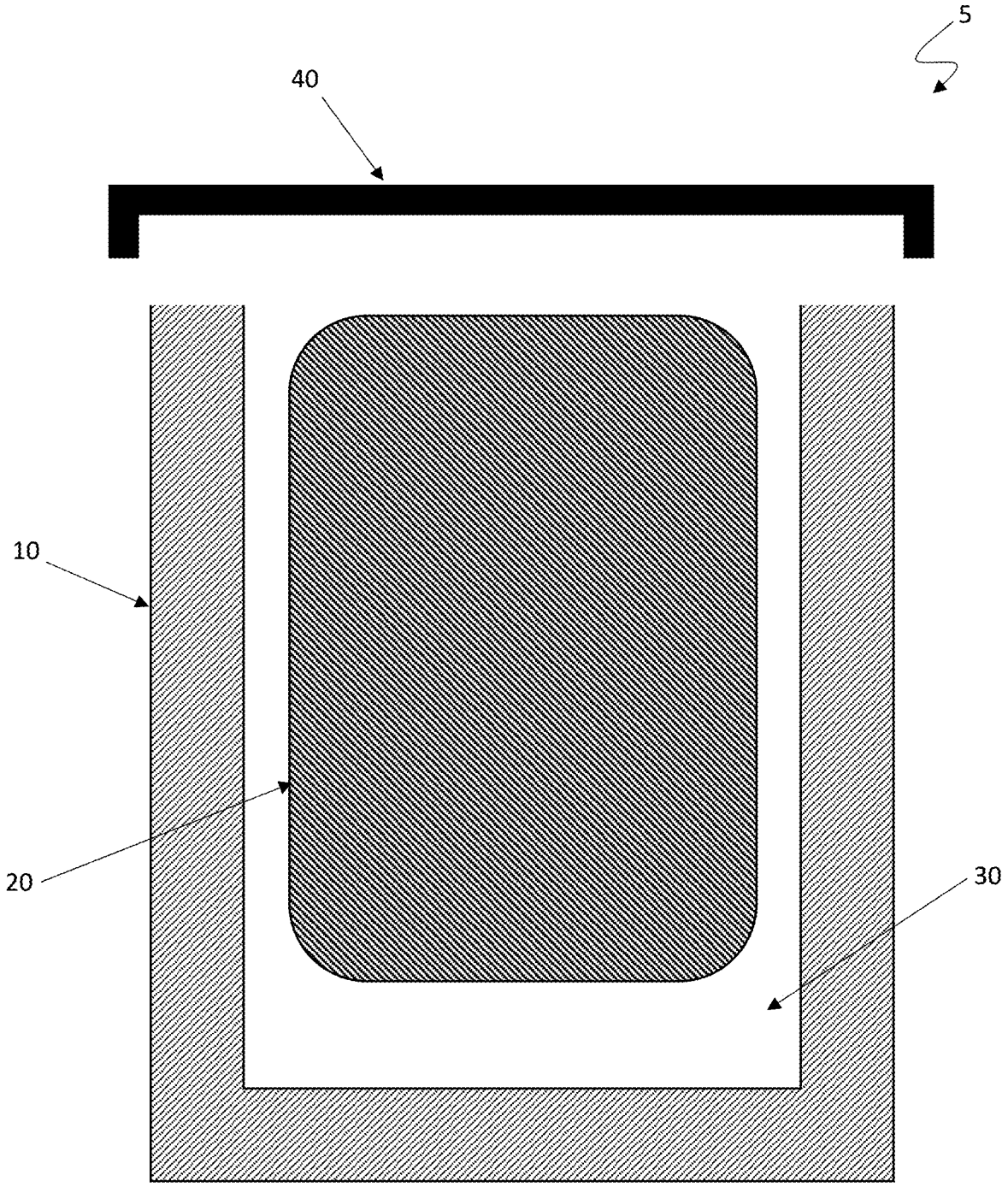
FIG. 1 depicts a schematic view of one exemplary embodiment of a microbubble storage and containment device.

The drawings and the following description relate to preferred embodiments by way of illustration only. It should be noted that from the following description, alternative embodiments of the components and methods disclosed herein will be readily recognizable as viable alternatives that may be employed in one skilled in the art.

In various exemplary embodiments, devices, systems and methods for providing supplemental oxygenation to various anatomical locations and/or features of a human or mammal can include system components that facilitate collection and storage of microbubble formulations for various periods of time under various conditions, and desirably allowing for ease of transport and/or delivery/use of such microbubbles under a variety of conditions.

In various embodiments, the disclosed systems, devices, techniques and/or methods can include one or more containers or components thereof that can be utilized to collect and store microbubble formulations and/or compounds that contain microbubble formulations, and which desirably promote the durability and/or inhibit the degradation of the microbubbles containing oxygen and/or other substances (including oxygen microbubbles or OMBs) contained therein.

In various embodiments, the packaging contents, "payload" or oxygen microbubble (OMB) carrier may comprise oxygen filled bubbles having a shell composed of an amphiphilic surfactant phospholipid monolayer, a cross-linked polymer, or a combination of phospholipids and polymers, in combination with other compounds to form a mixture, a solution, a froth, a water, a cream, a lotion, a beverage, an extract, a paste, a powder, a gel, a tincture, or some other liquid, semi-solid and/or flowable material.

In some embodiments, the packaging may utilize "passive" techniques and/or components to facilitate dispensing of the contents (i.e., by utilizing gravity to pour out contents and/or pressure differentials to expel contents out of a container), while in other embodiments the packaging can optionally incorporate "active" techniques and/or components to facilitate such dispensing (i.e., employing "squeeze-pack" components or plunger-type arrangements). If desired, a given container could utilize one or more dispensing techniques of a single type, or a plurality of dispensing techniques of a single type, or a combination of active and passive techniques or components, or any combinations thereof, where appropriate. If desired, some embodiments of a container may include a plurality of dispensing modalities, such as a squeeze pack component that might also be capable of being poured out through an alternative opening or other component.

In at least one embodiment, devices, systems and methods are disclosed which incorporate packaging materials to provide a separate sterile barrier and gas-impermeable barrier for protection of the contents therein. The packaging system can comprise a generally flexible inner container which is contained within a substantially more rigid outer container. The inner container will desirably contain the contents (which in at least one exemplary embodiment can be a product containing oxygen microbubbles) and may have ports for filling or draining of the container which may or may not extend through the outer container.

Unlike normal medical packaging for aseptic products, which typically consist of a single container (plastic or glass) which may be shipped in standard exterior packaging such as corrugated cardboard boxes (which are only designed for transit protection), the disclosed unique combination of packaging materials and components provides protection from ambient gasses, pressure changes and other environmental conditions while still providing product in a form factor that is recognizable and easily used by the user.

FIG. 1 depicts a schematic view of one exemplary embodiment of a microbubble containment device 5, which comprises a generally rigid outer container 10, a flexible inner container 20, a void or open region 30 within the outer container 10, and a closure or lid 40. In this embodiment, the outer container 10 may comprise glass, metal, polymers, or other gas-impermeable material, (or various combinations thereof), with an openable lid 40 through which the inner container 20 may be inserted or removed. In various embodiments, the inner container 20 can comprise virtually any flexible material known in the art including, but not limited to, polymers or other plastic materials.

Desirably, the outer container allows a chosen gas headspace to be maintained within the open region 30 while also providing protection to the inner container from pressure, crushing, etc. The outer container may also provide a space for a pump and other accessories and may include a separate section (not shown) to accommodate such components.

In various embodiments, the outer container may be "ruggedized" for protection from impact, dirt, dust, sand, water, etc. The outer container may also be insulated to protect the contents from changes in temperature. Insulation could also extend the "field" life of a refrigerated product by keeping it cool longer once removed from refrigeration. The addition of a ruggedized outer container with insulation desirably prevents degradation of the product for extended periods when refrigeration is not available, such as field deployments in the military or ambulances and first response situations.

Desirably, the open region 30 can be filled with a gas (oxygen, nitrogen, carbon dioxide, air, etc.) or mixtures of gas as appropriate. In various embodiments, the outer container 20 and/or lid 40 may include ports and/or other components extending therethrough for filling, draining and/or otherwise altering or monitoring the gas contents within the open region 30.

In various embodiments, the interior of the outer container may be sterile or non-sterile. Where the interior is sterile, the container will desirably maintain such sterile condition for extended periods of time, as appropriate. The outer container or lid may also include a partition (not shown) to maintain sterility of the inner chamber while any included delivery device or accessories may be removed from the outer container. The partition may be gas permeable to allow the headspace (i.e., a portion of the void) to extend into both areas of the outer container or lid.

In various embodiments, the inner container can be mounted or "suspended" within the outer container, such as by using a ring or similar mount (not shown) that is sandwiched or positioned between the outer container and the lid. The mount will keep the inner container from impacting or "bouncing off" of the inner surfaces of the outer container when the outer container is moved. In some embodiments the mount may include a rubberized or flexible linkage (not shown) between the inner and outer containers to desirably isolate or dampen the inner container from shaking or vibrations, etc., which may affect the outer container.

In various embodiments, the outer container and/or lid may or may not be intended to maintain an internal pressure higher than atmospheric pressure (i.e., it desirably may or may not act like a pressure vessel). If desired, the outer container and/or lid may include safety ports or other features (i.e., a pressure sensitive lid sealing arrangement) designed to bleed excess internal pressure automatically or manually.

In other embodiments, the outer container and/or lid may or may not be intended to maintain an internal pressure lower than atmospheric pressure. If desired, the outer container and/or lid may include safety ports or other features (i.e., a pressure sensitive lid sealing arrangement) designed to equalize pressure automatically or manually.

If desired, the outer container and/or lid may also have valves or other features designed to allow the user to break vacuum pressure or excess pressure if the container is taken to a lower/higher atmospheric pressure after being sealed (or where local atmospheric pressure has changed for some reason). In some embodiments, such pressure equalization may be accomplished relatively quickly and/or slowly (i.e., over a period of time such as one-half second, 1 second, 2 seconds, 5 seconds, 10 seconds, 30 seconds, 1 minute, 5 minutes, 10 minutes, 30 minutes, an hour or longer) to minimize disruption and/or damage to the microbubbles contained therein.

When the microbubble product is to be deployed, the user can desirably open the outer container (after equalizing pressure first, using a relief valve if necessary). This approach can eliminate the gas headspace, allowing the product to be used within a specified amount of time before excessive gas transfer to the inner container occurs. The inner container is then connected to the desired delivery system. The contents of the inner container are then administered by the appropriate pump, squeeze or gravity feed method.

Figure 2:
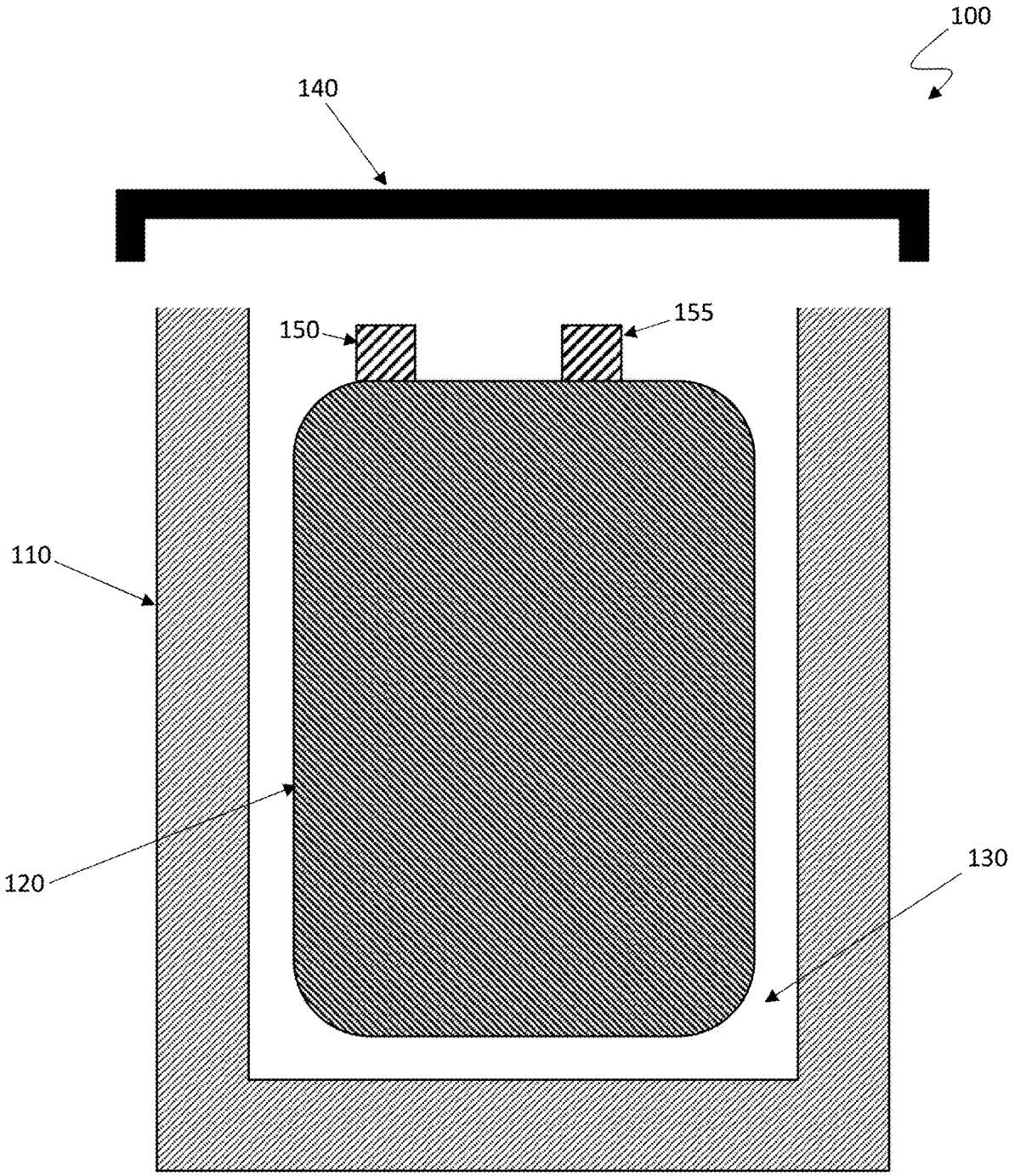
FIG. 2 depicts a schematic view of another alternative exemplary embodiment of a microbubble containment device.

In the disclosed embodiment, the mounting and flexibility of the inner container 20 will desirably allow the inner container 20 to be removed from the opened outer container 10, with a user being able to "squeeze" or otherwise collapse the inner container 20 to reduce the inner container volume to pressurize and/or expel the microbubble contents from the inner container 20 in a desired manner. The inner container may also be designed to be compressed by hand or rolled once removed from the outer container, or by hand or with a plunger while still in the outer container to deliver the contents FIG. 2 depicts a schematic view of another alternative exemplary embodiment of a microbubble containment device 100, in which the inner container 120 can incorporate a plurality of openings or access ports, such as inlet opening 150 and outlet opening 155. If desired, one or more of these openings may be closeable openings, or they may incorporate frangible closures or self-sealing openings, if desired. In at least one alternative embodiment, the inner container may incorporate a septum or membrane which does not utilize ports or openings for dispensing, but instead can be punctured by a needle to access the contents.

Figure 3:
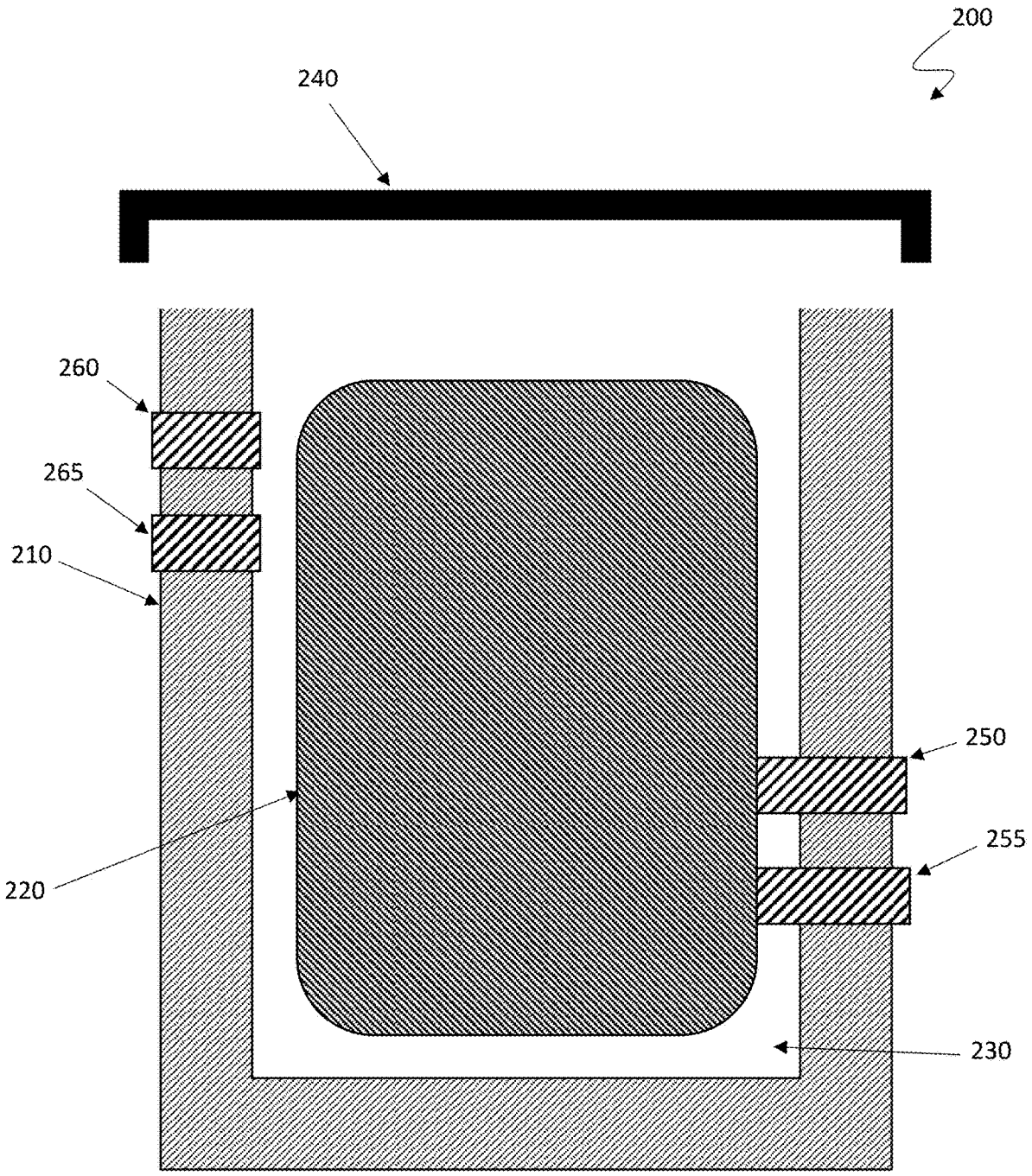
FIG. 3 depicts a schematic view of another alternative exemplary embodiment of a microbubble containment device.

FIG. 3 depicts a schematic view of another alternative exemplary embodiment of a microbubble containment device 200, in which the outer container 210 can incorporate connectors 250 and 255 (or tubing or other accessories) that can allow the contents of the inner container to be expelled through the wall of the outer container.

Figure 4:
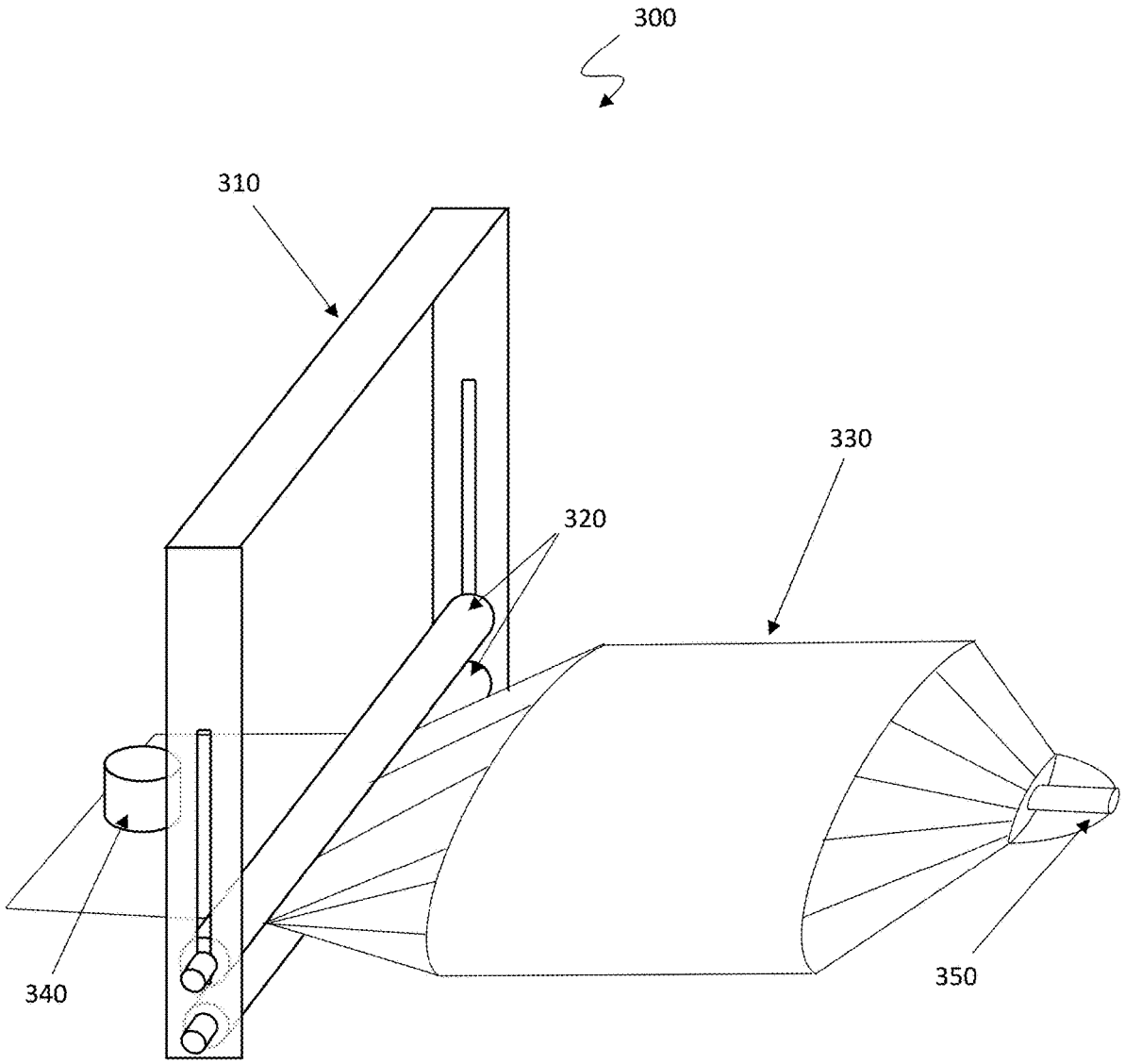
FIG. 4 depicts a perspective view of an exemplary embodiment of a dispensing device for use with various embodiments disclosed herein

FIG. 4 depicts a perspective view of an exemplary embodiment of a dispensing device 300 for use with various embodiments disclosed herein. The dispensing device 300 can comprise a roller wringer having a frame 310 with a pair of adjustable rollers 320 mounted therein. During use, an end of a flexible inner container 330 such as those described herein can be placed between the rollers 320, and the user can draw the container 330 (using a handle 340 or similar portion) through the frame, with the rollers desirably compressing the container 330 and urging the microbubble contents of the container 300 out of an opening 350 in an opposing end of the container. If desired, one or more of the rollers 320 could include a crank handle or other mechanical or powered device (not shown) to assist with rotation and squeezing/expelling of the container contents.

Figure 5:
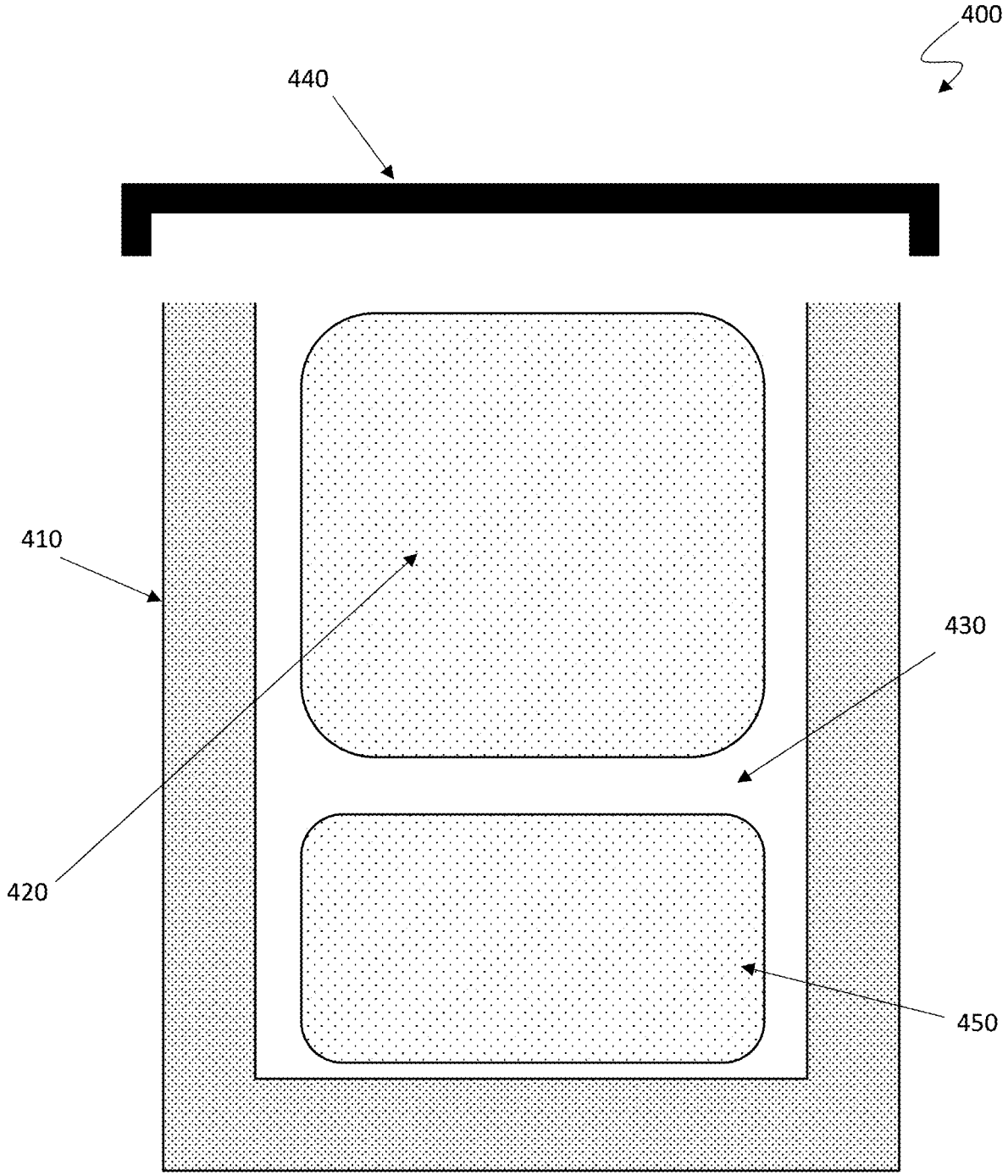
FIG. 5 depicts a schematic view of another alternative exemplary embodiment of a microbubble containment device.

FIG. 5 depicts a schematic view of another alternative embodiment of a microbubble containment device 400, which desirably includes a generally rigid outer container 410, a flexible inner container 420, a void or open region 430 within the outer container 410, and a closure or lid 440. In addition to the inner container, an accessory storage area 450 can be provided within the outer container 410, which can contain such additional components as a dispensing system or pump or similar components, as desired.

Figure 6:
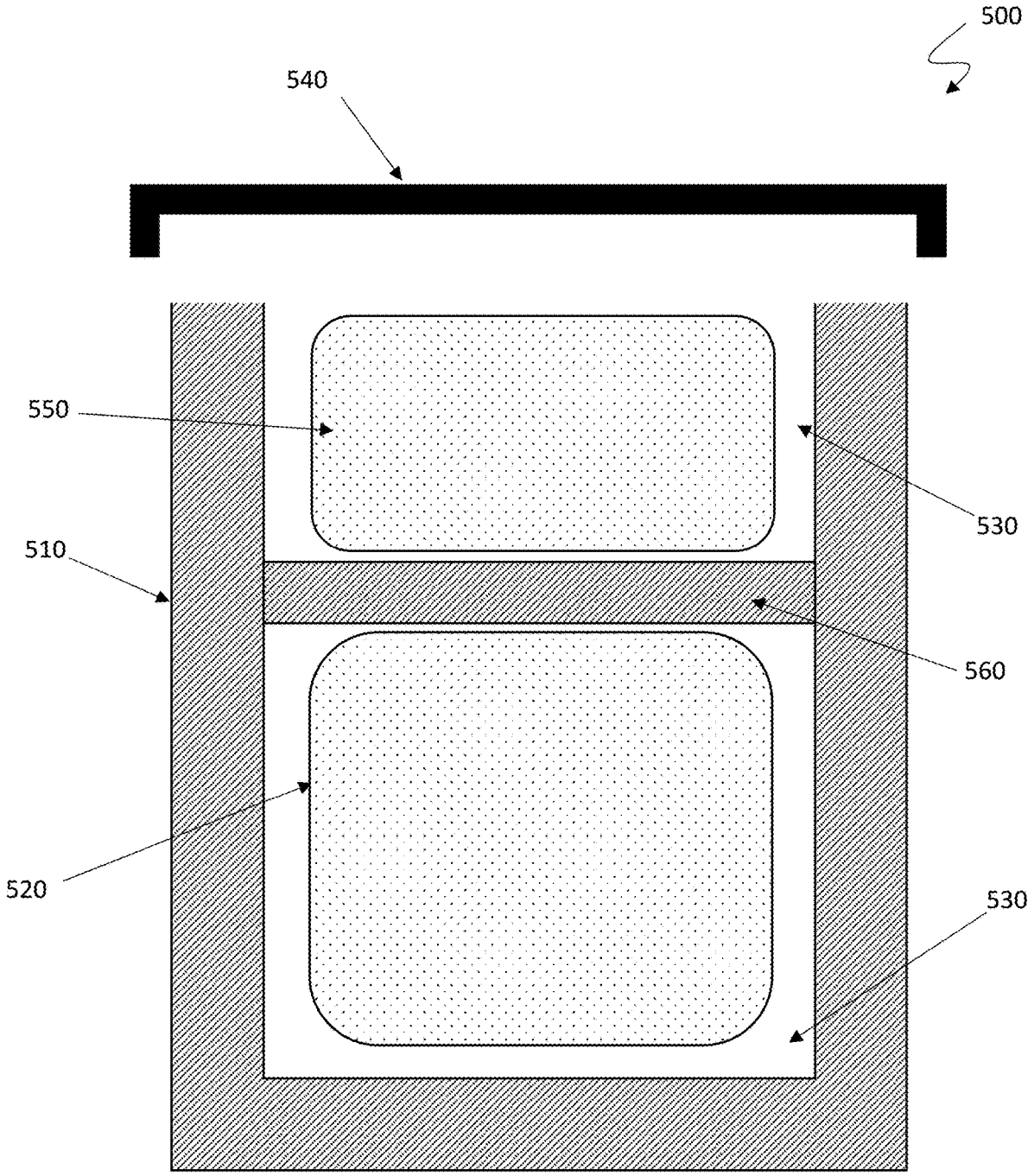
FIG. 6 depicts a schematic view of another alternative exemplary embodiment of a microbubble containment device.

FIG. 6 depicts a schematic view of another alternative embodiment of a microbubble containment device 500, which desirably includes a generally rigid outer container 510, a flexible inner container 520, a plurality of voids or open regions 530 within the outer container 510, and a closure or lid 540. In this embodiment, an accessory storage area 550 is provided within the outer container 510, with the accessory storage area 550 separated from the flexible inner container 520 by a removeable partition 560, which can optionally desirably maintain sterility of the inner container prior to removal of the partition 560. If desired, various additional components such as a dispensing system or pump or similar components can be placed within the area 550, as desired.

In various embodiments, the inner container may be packaged with a manual delivery device in various location within the void 530. The manual delivery device may be pre-installed on tubing lines, on the inner container itself, or may be separate from the inner container but inside, through and/or outside of the outer container. The manual delivery device may be installed in line with a container exit port (a bulb pump, elastomeric pump, etc.) or it may be used on the container itself to force the contents out the exit port (rollers, squeegee, a bar clamp which may be rolled to roll up the container, etc.).

Figure 7:
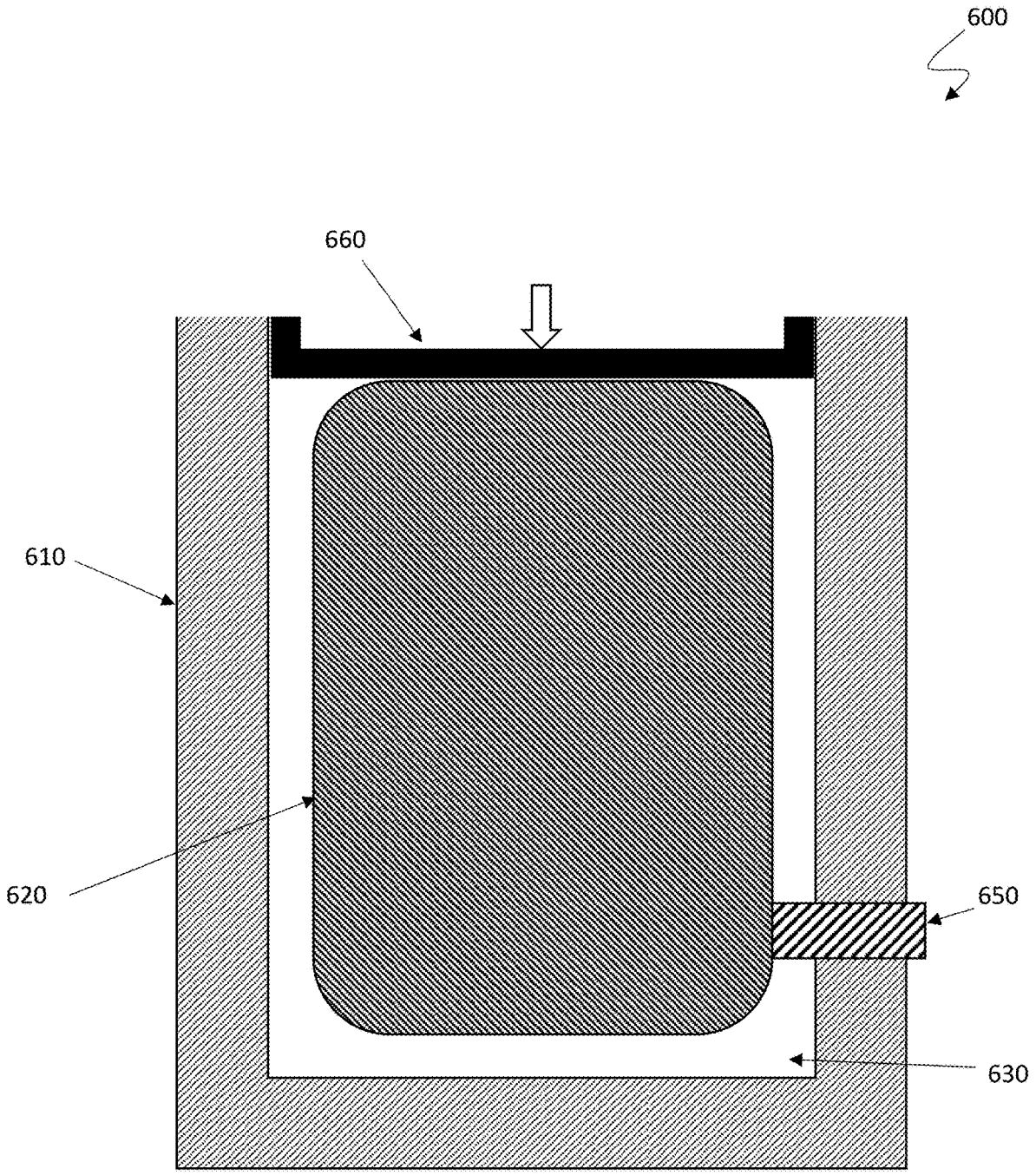
FIG. 7 depicts a schematic view of another alternative exemplary embodiment of a microbubble containment device.

FIG. 7 depicts a schematic view of another alternative embodiment of a microbubble containment device 600, which desirably includes a generally rigid outer container 610, a flexible inner container 620, one or more voids or open regions 630 within the outer container 610, and a closure or lid (not shown). Also depicted is an optional moveable wall or compression plate 660 which can be utilized to reduce the volume within the void 630, desirably forced microbubbles out of a dispensing port 650 connected to the inner container. As shown, the dispensing port 650 may optionally extend through a wall of the outer container. In this embodiment, the inner container can may also be designed to allow for delivery from the top of the container. This "bottom to top" delivery method allows the delivery of foam or bubble type solutions to ensure that the rising bubbles are delivered to the patient and not left in the top of the container while the heavier liquid solution drains from the bottom.

Figure 8:
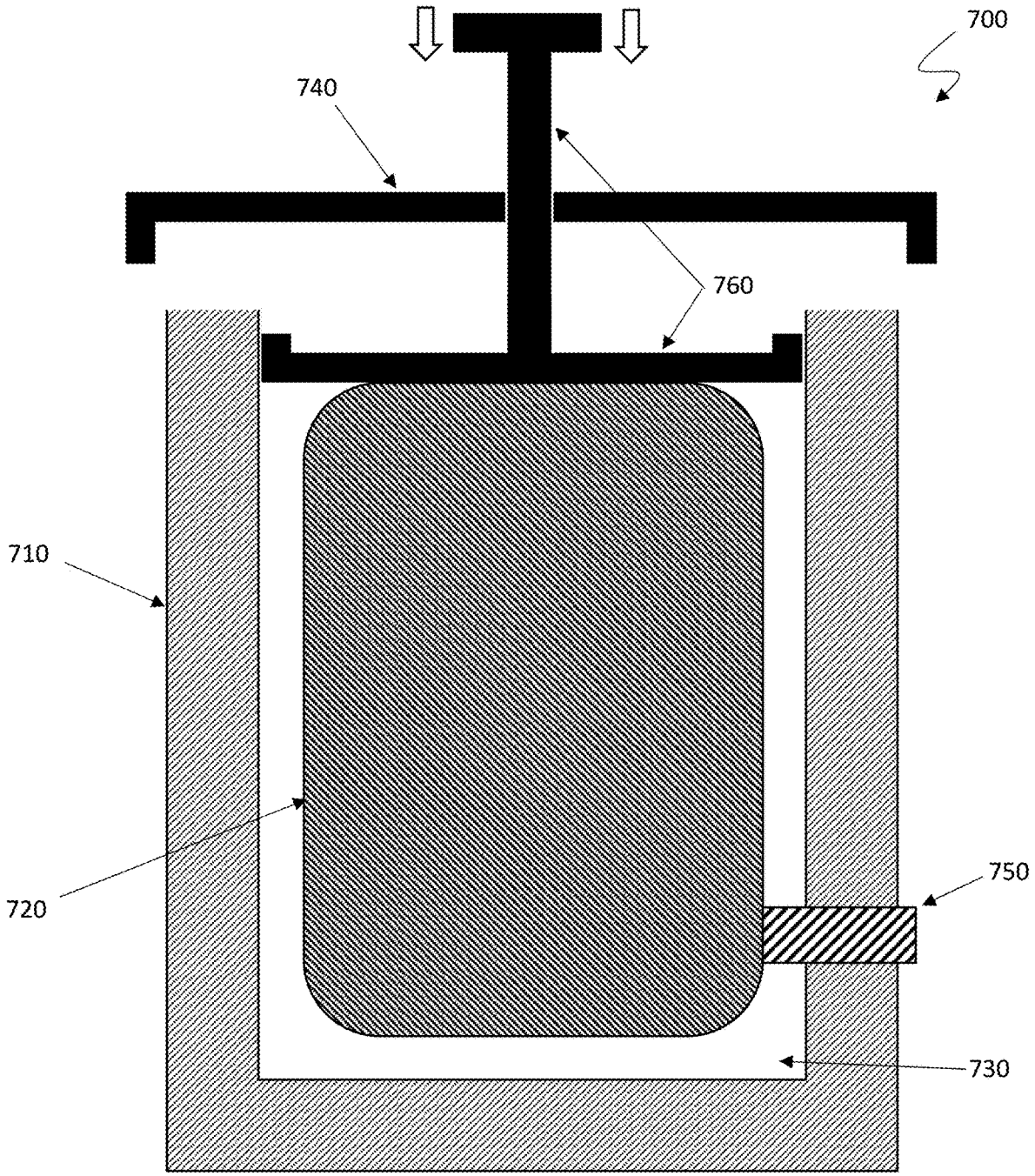
FIG. 8 depicts a schematic view of another alternative exemplary embodiment of a microbubble containment device.

FIG. 8 depicts a schematic view of another alternative embodiment of a microbubble containment device 700, which desirably includes a generally rigid outer container 710, a flexible inner container 720, one or more voids or open regions 730 within the outer container 710, and a closure or lid 740, which can also optionally include a plunger 760 which can be advanced and utilized to reduce the volume within the void 730, desirably forced microbubbles out of a dispensing port 750 connected to the inner container. Desirably, the plunger can include a sealing arrangement that prevents loss of sterility during storage and transport, but which allows advancement of the plunger when dispensing of the microbubbles is desired. If desired, the inner container can be designed to allow for delivery from the top of the container, with some portion of the inner container remaining below the dispensing port to collect the liquid carrier that may form at the bottom of the container (i.e., after some microbubbles have coalesced during storage, for example). This "bottom to top" delivery method allows the delivery of foam or bubble type solutions to ensure that the rising bubbles are delivered to the patient and not left in the top of the container while the heavier liquid solution drains into and/or is collected within the bottom.

Figure 9:
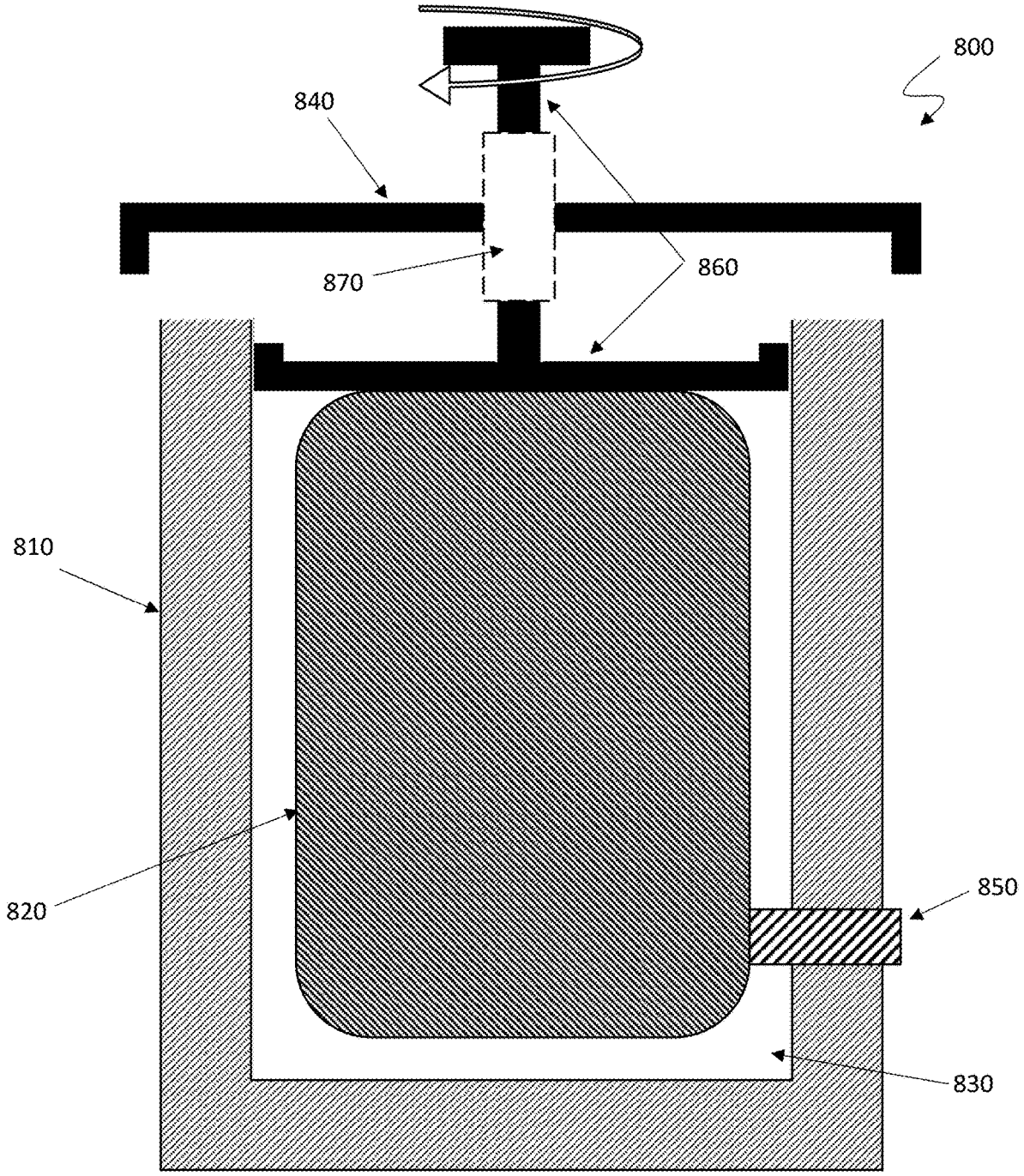
FIG. 9 depicts a schematic view of another alternative exemplary embodiment of a microbubble containment device.

FIG. 9 depicts a schematic view of another alternative embodiment of a microbubble containment device 800, which desirably includes a generally rigid outer container 810, a flexible inner container 820, one or more voids or open regions 830 within the outer container 810, and a closure or lid 840, which can also optionally include a plunger 860 which can be advanced and utilized to reduce the volume within the void 830, desirably forced microbubbles out of a dispensing port 850 connected to the inner container. Desirably, the plunger can include a sealing arrangement that prevents loss of sterility during storage and transport, but which allows advancement of the plunger when dispensing of the microbubbles is desired. Moreover, this embodiment can optionally include a threaded arrangement 870 between the plunger and lid which, when the plunger is rotated, advances the plunger when dispensing of the microbubbles is desired. In various embodiments, a portion of the plunger may optionally be separable or modular, allowing for a portion of the plunger assembly to remain within the outer container during storage and/or transport (i.e., without fear of contacting the plunger shaft and inadvertently compressing the inner container), but which allows for plunger assembly and compression of the plunger without requiring opening of the container once dispensing of the microbubble contents is desired.

In the various embodiment disclosed and described herein, the inclusion of a delivery device (or components designed to accommodate hand-squeezing or other simplified delivery techniques) and any other accessories, means that the product may be supplied as a "kit" with everything required for administration of the product contained inside the outer container at the site of a medical procedure. Desirably, the pumps and/or accessories utilized with the kit can include components that are ruggedized for field use and optionally include manually operable components (where possible), thereby allowing sensitive and/or delicate medical products to be able to be used in more diverse environments.

Figure 10:
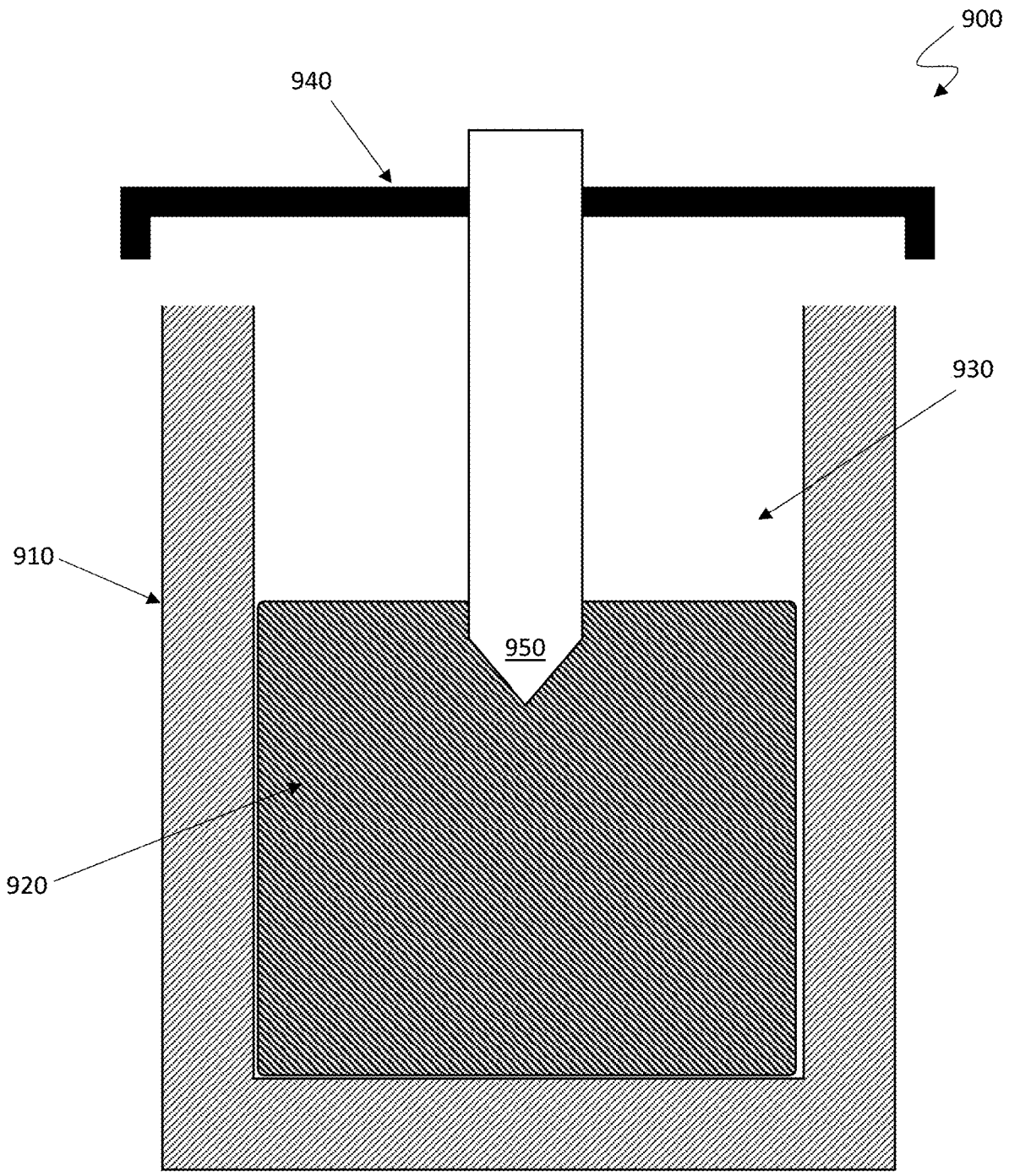
FIG. 10 depicts a schematic view of another alternative exemplary embodiment of a microbubble containment device.

FIG. 10 depicts a schematic view of another alternative embodiment of a microbubble containment device 900, which desirably includes a generally rigid outer container 910 with one or more voids or open regions 930 within the outer container 910, and a closure or lid 940. In this embodiment, which can optionally incorporate either a single outer container or both an inner and outer container (not shown) can further include an attached or encapsulated sonicator tip 950, which can allow a solution 920 within the void 930 to be sterilized or aseptically filled and sealed prior to a sonication process to avoid future exposure to the environment. The sonicator tip may be attached to either the inner and/or outer container, both containers, the inner container and the closure lid or just the closure lid. The sonicator tip may be positioned at the solution/gas interface or it may be submerged in the solution. The sonicator tip may be threaded or use other means of attachment to connect to a sonicator head. If an inner container is used, it may have fill and/or drain ports (not shown) to allow the addition or removal of solution. The product may then be sonicated to mix the solution, disperse contents, or generate bubbles. If necessary, leftover or excess fluid may be drained aseptically from a drain port. The product is then packaged and distributed with the sonicator tip included. The contents are never exposed to the ambient environment until used by the end user In various embodiment, the inclusion of a sonicator tip and associated microbubble equipment included in various embodiments could optionally include power connections for connection to external power and/or control devices, or could alternatively include installed batteries and/or power/control equipment if necessary. Such embodiments can facilitate the transport and/or storage of sterile microbubble precursors, with sonication occurring within the enclosed chamber on an "as-needed" basis within the medical facility for immediate or short-term usage—thereby preventing potential exposure to contaminants, making the process more efficient and reducing the opportunity for degradation of microbubbles during long-term storage and/or transport.

In some instances, it may be advantageous to provide a container being pre-loaded with some amount of a liquid solution, with a gas such as oxygen within a head space above the liquid (with additional oxygen or other gases potentially available within an attached reservoir cylinder or via an installed system that is attached to the container). When oxygen microbubbles are required for a medical procedure, the sonicator tip may be activated, and microbubbles created from the solution and oxygen. In this manner, microbubbles are created at the point of use, and concerns with storage and transport of fully formed microbubbles can be reduced and/or avoid.

Figure 11:
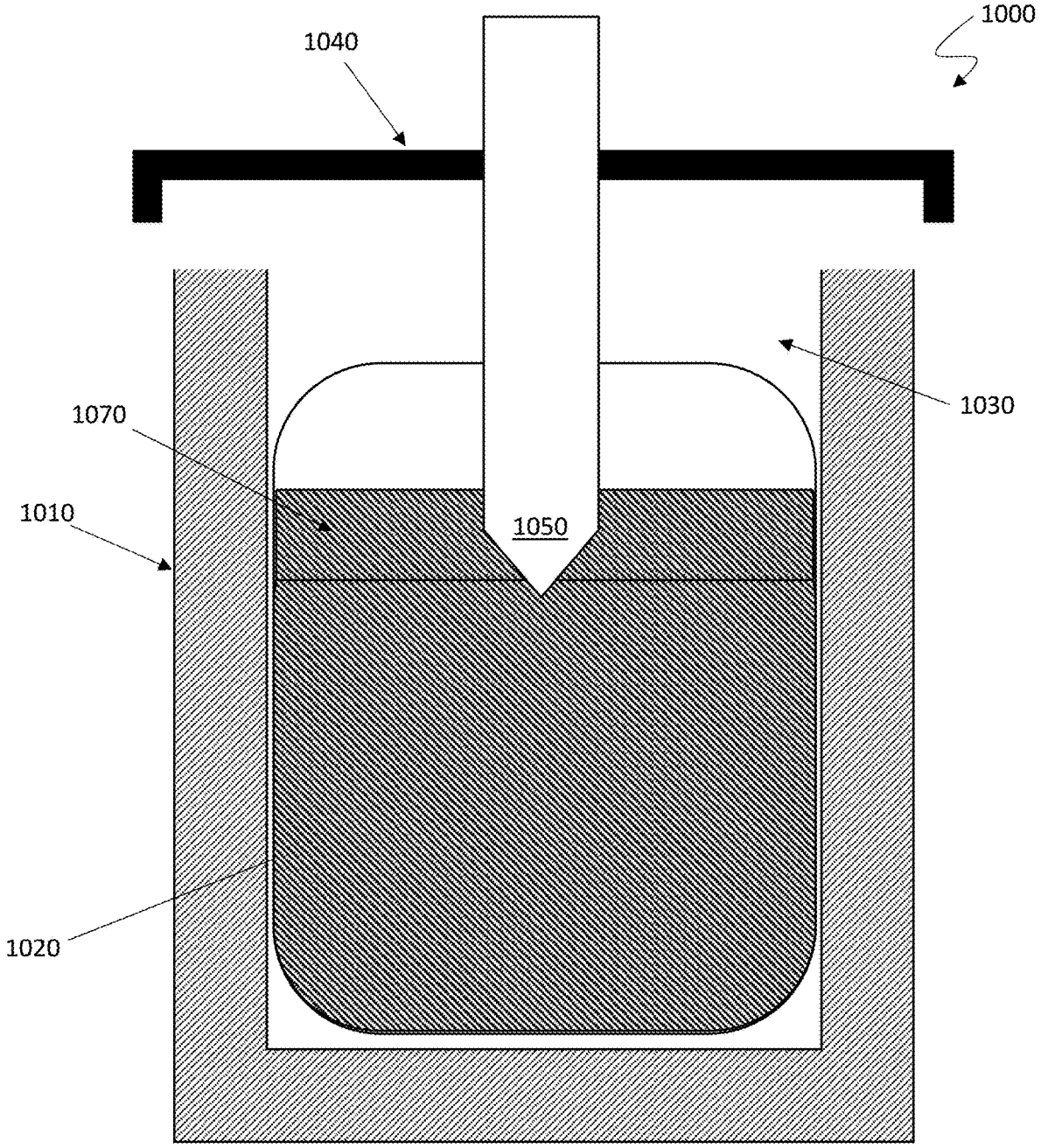
FIG. 11 depicts a schematic view of another alternative exemplary embodiment of a microbubble containment device.

FIG. 11 depicts a schematic view of another alternative embodiment of a microbubble containment device 1000, which desirably includes a generally rigid outer container 1010 with one or more voids or open regions 1030 within the outer container 1010, and a closure or lid 1040. In this embodiment, which can optionally incorporate either a single outer container or both an inner and outer container (not shown) can further include an attached or encapsulated sonicator tip 1050, which can allow a solution 1020 within the void 1030 to be sterilized or aseptically filled and sealed prior to a sonication process to avoid future exposure to the environment. In this embodiment, the sonicator tip 1050 is positioned just below the upper level of the solution 1020, with a microbubble product 1070 being formed above an upper surface of the solution.

In various embodiment, an OMB formulation may also provide pain reliving effects. For example, phospholipid monolayer microbubbles may be used in combination with other gases and additives to provide an optimum composition for specific physiologic effects. Anesthetic gases delivered by diffusion and/or absorption from the phospholipid monolayer microbubbles may (1) provide enhanced local anesthetic saturation levels for mammals; (2) provide enhanced anesthetic performance by delivery of anesthetic agents to the body. In various embodiments, a variety of anesthetic compounds may be delivered in conjunction with the OMB formulation, which may include substances to augment anesthetic compounds provided for certain medical purposes as well as agents that may enable and/or enhance anesthetic effects for pain relief, surgical interventions, dental treatments, and relief of physical discomfort.

According to the invention, OMBs can be designed for high oxygen carrying capacity, high oxygen delivery rate and sufficient stability for storage and transport. Direct oxygenation by applying OMBs to the surface of various tissues is a radical change from existing oxygen delivery platforms.

As used herein, microbubbles generally refer to micron-sized (e.g., in the range of 1 um to 1000 um in diameter) substantially-spherical gas-filled particles in solution that are stabilized by an organic coating at the gas-liquid interface. The stability, gas diffusion properties, and biocompatibility of microbubbles can be controlled via the formulation of the coating material (i.e., the microbubble shell). Customizing the stabilizing shell of the microbubbles can allow fabricated microbubbles to be stored for later use. Alternatively, the microbubbles may be used immediately after fabrication. In such cases, the coating material may be sufficiently stable as to allow the microbubble to deliver its gas payload to an intended target (e.g., into and/or through the tissue layers of a patient).

According to various features of the present invention, OMBs can be designed and constructed for high oxygen carrying capacity, high oxygen delivery rate and/or sufficient stability for storage and transport. The procedure for delivery of OMBs to the surface of the tissue is simple and straightforward, and requires little or no special equipment to accomplish. In addition, larger microbubbles (about 10-25 um diameter) can be utilized in the various formulations herein without fear of adverse effects, because they are separated by exterior tissue layers from the internal tissues and vasculature. Thus, it is contemplated that microbubbles may be between 1-100 um in diameter and even between 1-500 um in diameter. In addition, mixtures of microbubbles may comprise microbubbles of different sizes. The sizes of the OMBs contained within any one mixture may be only smaller microbubbles, only larger microbubbles or a combination of both smaller and larger microbubbles.

In various embodiments, the delivery of a gas contained within the phospholipid and/or polymeric monolayer shell microbubble may include gases other than oxygen, or in combination with oxygen, including nitrogen, hydrogen, fluorine or fluorinated gases, chlorine, helium, neon, argon, krypton, xenon and/or radon in varying compositions according to the desired therapeutic effect. Hyperoxic mixes may be used as a means to draw dissolved inert gases from the body. In other embodiments, the microbubbles may include gaseous compounds other than oxygen, or in combination with oxygen or other elements, including NO2 (nitrous oxide), CO2 (carbon dioxide) CH4 (methane), NH3 (ammonia), HCN (hydrogen cyanide), CO (carbon monoxide), NO (nitric oxide), C2H6 (ethane), PH3 (phosphine), H2S (hydrogen sulfide), HCl (hydrogen chloride), CO2 (carbon dioxide), N2O (dinitrogen oxide), C3H8 (propane), NO2 (nitrogen dioxide), O3 (ozone), C4H10 (butane), SO2 (sulfur dioxide), BF3 (boron trifluoride, Cl2 (chlorine), CF2Cl2 (dichlorodifluoromethane) and/or SF6 (sulfur hexafluoride) in varying compositions according to the desired therapeutic effect.

The ability to deliver oxygen from OMBs via various application may also have significant clinical implications. For example, where hypoxia of a tissue region occurs (due to vascular obstruction and/or constriction or due to other causes) the local and/or systemic application of an OMB formulation containing readily accessible oxygen-bearing microbubbles may prevent injury and/or necrosis of tissues for varying lengths of time. Such applications could include the delivery of supplemental oxygen in lower concentrations (i.e., less than 25% of physiologic demand or less than 20% of physiologic demand or less than 15% of physiologic demand or less than 10% of physiologic demand or less than 5% of physiologic demand or less than 4% of physiologic demand or less than 3% of physiologic demand or less than 2% of physiologic demand or less than 1% of physiologic demand).

Phospholipid monolayer or cross-linked polymer or phospholipid-polymeric microbubbles may be used in combination with other fluids and additives to provide an optimum composition for specific physiologic effects. Oxygen delivered by local or systemic application of a microbubble suspension may promote healing of wounds, burns, or other injuries where oxygen is of importance to reduced healing or recovery time and/or provide enhanced delivery of oxygen and/or other compounds (i.e., sucrose, glucose, CBD, caffeine, or other agents) to the body. In various embodiments, a variety of compounds may be delivered in conjunction with the OMB formulation, which may include substances to encourage and/or facilitate the passage of oxygen and other gases into and/or out of various tissues, as well as substances that may enable and/or enhance absorption of OMB constituents.

In various embodiment, microbubbles may be employed which utilize surfactant and lecithin-based mixtures (which may provide varying levels of effectiveness in various alternative embodiments). However, using known and isolated amphiphilic phospholipids and biocompatible polymers as the shell material in OMBs desirably provides a mixture composition that is fully understood, thereby allowing for the behavior of the OMBs to be relatively predictable. This enhanced OMB behavior predictability allows the OMBs to be fabricated for greater stability, control of oxygen release, manufacturability, improved storage and handling, and greater efficacy in oxygen delivery. Additionally, OMBs on the order of 1-1000 um in diameter experience a lower internal Laplace pressure (responsible for driving dissolution) than OMBs 1-999 nm in diameter range, allowing the micron-sized OMBs to persist longer on the tissue surface.

Oxygen microbubbles can be produced using a variety of production methods and/or techniques, including continuous production and/or batch production. If desired, the OMBs can be produced immediately prior to use, or they can be manufactured and stored for extended periods of time prior to use in the various embodiments described herein. In at least one exemplary embodiment, the size of the OMBs utilized herein can be primarily distributed between 1 and 10 microns (um) in diameter, although larger and/or smaller microbubbles and/or microbubble distributions can be utilized in a variety of the disclosed embodiments with varying results.

Although larger OMBs as a whole, with their lipid shell, may not be expected to substantially diffuse through all tissues to their target, oxygen is a small molecule that is expected to enter tissues intercellularly and through the transappendageal pathway. The diffusion of oxygen from the OMBs to the peritoneum, the muscle-tissue lining of the abdominal cavity, is well-documented and has been modeled theoretically and studied in vivo, justifying the use of OMBs to deliver oxygen directly to tissues. Literature also exists on oxygen diffusion through various tissues which estimates mass transfer coefficients and partial pressures of the tissue layers. Thus, in various embodiments, it is proposed that the application of an OMB formulation to various tissues can allow oxygen and/or other compounds to penetrate and oxygenate bodily tissues, both locally and/or systemically.

Drug Delivery

In various embodiments, the application of OMBs and/or other microbubble formulations may enhance and/or facilitate the delivery and/or absorption of oxygen (or reverse transfer of carbon dioxide) and/or may enhance and/or facilitate the delivery of other compounds and/or medications in local and/or systemic manners. For example, OMBs and/or other microbubble formulations may be particularly useful in delivering cannabinoids and/or similar substances to an individual, including the psychoactive $\Delta^9$-tetrahydrocannabinol (THC) and the non-psychoactive cannabidiol (CBD), commercially available as pharmaceutical formulations such as Nabiximols (Sativex®—a commercially available oromucosal spray that contains a mixture of THC and CBD) and Dronabinol (Marinol®), an oral preparation of synthetic THC. In addition, the phospholipid monolayer variation of microbubbles described herein may have particular affinity and usefulness in conjunction with the lipid-soluble cannabinoids THC and CBD, as the co-administration of lipids may increase absorption and/or bioavailability of THC in mammals by more than 2.5-fold, and of CBD by almost 3-fold (which profound increase in systemic exposure may significantly affect the therapeutic effects or toxicity of these cannabinoids).

In various embodiments, a microbubble formulation may serve as a carrier to transfer THC and CBD to the systemic circulation via the lymphatic system following application with lipids. Drugs that are transported via the lymphatic system can avoid hepatic first-pass metabolism and therefore achieve significantly higher bioavailability than after administration in lipid-free formulation. Thus, co-administration of microbubble lipids may substantially increase the systemic exposure to *cannabis* or *cannabis*-based medicines, and testing suggests that one primary mechanism of the increased absorption of cannabinoids in the presence of lipids may be lymphatic transport. Desirably, an amount of lipid present in the microbubble formulation could be sufficient to "humidify" and/or soften the tissue surface and promote the absorption of cannabinoids, thereby increasing the potential systemic exposure to cannabinoids. The increase in systemic exposure to cannabinoids in humans is of potentially high clinical importance as it could turn a barely effective dose of administered *cannabis* into a highly effective one, or be a mechanism for adjustment of effective therapeutic dose.

OMB Formulation Delivery & Packaging

In various embodiments, the OMB formulations describe herein can be manufactured, stored and/or delivered in a variety of manners and packaging, including in resealable and/or disposal, single-use packaging. In at least one exemplary embodiment, an OMB formulation can be manufactured and packaged in airtight packaging, with the formulation capable or remaining in a stable and usable condition for an extended period of time, such as up to 2 years or longer. Desirably, the packaging will allow the OMB formulation to remain fully sealed until the time of application, when the seal can be broken and the formulation applied quickly thereafter.

If desired, an OMB storage and delivery device could include multiple reservoirs for containing materials, including OMB formulations, which may allow for sequential application and/or allow for pre-mixing of contents prior to application. For example, it may be desirous to humidify and/or "wet" a tissue surface prior to OMB application to desirably facilitate the durability of the OMBs and/or the absorption of oxygen into the tissues. In such case, the OMB storage and delivery device could include a first reservoir containing a moisturizing agent containing a liquid, lipid or gel (or other commonly accepted moisturizing agents), and a second reservoir containing the OMB formulation, with first applying the moisturizer and then subsequently applying the OMB formulation. In another embodiment, the reservoirs might be combinable prior to application. This arrangement could allow the OMB formulation to remain relatively stable for transport, with mixing occurring immediately prior to use.

In various embodiments, the application of an OMB formulation could include situations where the OMB might comprise a wash or splashing agent, or even an aerosolized agent in some embodiments.

Microbubble Production

Oxygen microbubbles can be formulated with either a lipid monolayer shell, a biocompatible polymer shell, or a combination thereof. In addition to oxygen, the shell-stabilized microbubbles can be prepared with a variety of therapeutic gases. Additionally, these microbubbles can be formulated in a variety of biocompatible fluids that act as the continuous phase liquid for microbubble suspension. The lipids which may be used to prepare the gas and gaseous precursor filled microspheres used in the present invention include but are not limited to: lipids such as fatty acids, lysolipids, phosphatidylcholine with both saturated and unsaturated lipids including dioleoylphosphatidylcholine; dimyristoylphosphatidylcholine; dipentadecanoylphosphatidylcholine; dilauroylphosphatidylcholine; dipalmitoylphosphatidylcholine (DPPC); distearoylphosphatidylcholine (DSPC); phosphatidylethanolamines such as dioleoylphosphatidylethanolamine and dipalmitoylphosphatidylethanolamine (DPPE); phosphatidylserine; phosphatidylglycerol; phosphatidylinositol; sphingolipids such as sphingomyelin; glycolipids such as ganglioside GMI and GM2; glucolipids; sulfatides; glycosphingolipids; phosphatidic acids such as dipalymitoylphosphatidic acid (DPPA); pabnitic acid; stearic acid; arachidonic acid; oleic acid; lipids bearing polymers such as polyethyleneglycol, i.e., PEGylated lipids, chitin, hyaluronic acid or polyvinylpyrolidone; lipids bearing sulfonated mono-, di-, oligo- or polysaccharides; cholesterol, cholesterol sulfate and cholesterol hemisuccinate; tocopherol hemisuccinate; lipids with ether and ester-linked fatty acids; polymerized lipids (a wide variety of which are well known in the art); diacetyl phosphate; dicetyl phosphate; stearylamine; cardiolipin; phospholipids with short chain fatty acids of 6-8 carbons in length; synthetic phospholipids with asymmetric acyl chains (e.g., with one acyl chain of 6 carbons and another acyl chain of 12 carbons); ceramides; non-ionic liposomes including niosomes such as polyoxyethylene fatty acid esters, polyoxyethylene fatty alcohols, polyoxyethylene fatty alcohol ethers, polyoxyethylated sorbitan fatty acid esters, glycerol polyethylene glycol oxystearate, glycerol polyethylene glycol ricinoleate, ethoxylated soybean sterols, ethoxylated castor oil, polyoxyethylene-polyoxypropylene polymers, and polyoxyethylene fatty acid stearates; sterol aliphatic acid esters including cholesterol sulfate, cholesterol butyrate, cholesterol iso-butyrate, cholesterol palmitate, cholesterol stearate, lanosterol acetate, ergosterol palmitate, and phytosterol n-butyrate; sterol esters of sugar acids including cholesterol glucuroneide, lanosterol glucuronide, 7-dehydrocholesterol glucuronide, ergosterol glucuronide, cholesterol gluconate, lanosterol gluconate, and ergosterol gluconate; esters of sugar acids and alcohols including lauryl glucuronide, stearoyl glucuronide, myristoyl glucuronide, lauryl gluconate, myristoyl gluconate, and stearoyl gluconate; esters of sugars and aliphatic acids including sucrose laurate, fructose laurate, sucrose palmitate, sucrose stearate, glucuronic acid, gluconic acid, accharic acid, and polyuronic acid; saponins including sarsasapogenin, smilagenin, hederagenin, oleanolic acid, and digitoxigenin; glycerol dilaurate, glycerol trilaurate, glycerol dipalmitate, glycerol and glycerol esters including glycerol tripalmitate, glycerol distearate, glycerol tristearate, glycerol dimyristate, glycerol trimyristate; longchain alcohols including n-decyl alcohol, lauryl alcohol. myristyl alcohol, cetyl alcohol, and n-octadecyl alcohol; 6-(5-cholesten-3 yloxy)-1-thio-D-galactopyranoside; digalactosyldiglyceride; 6-(5-cholesten-3-yl oxy) hexyl-6-amino-6-deoxy-1-thio-D-galactopyranoside; 6-(5-cholesten-3-yloxy)hexyl-6-amino-6-deoxyl-1-thio-a-D-mannopyranoside; 12-(((7'-diethylaminocoumarin-3-yl) carbonyl)methylamino)-octadecanoic acid; N-[12-(((7'-diethylaminocoumarin-3-yl) carbonyl)methyl-amino) octadecanoyl]-2-aminopalmiticacid; cholesteryl) 4'-trimethylammonio)butanoate; N-succinyldioleoylphosphatidylethanolamine; 1,2-dioleoyl-sn-glycerol;l,2-dipalmitoyl-sn-3-succinylglycerol; 1,3-dipalmitoyl-2-succinylglycerol;l-hexadecyl-2-palmitoyl glycerophosphoethanolamine and palmitoylhomocysteine, and/or combinations thereof.

If desired, a variety of cationic lipids such as DOTMA, N-[1-(2,3-dioleoyloxy)propyl]-N,N,N-trimethylammoium chloride; DITTAP, 1,2-dioleoyloxy-3-(trimethylammonio) propane; and DOTB, 1,2-dioleoyl-3-(4'-trimethyl-ammonio) butanoyl-sn-glycerol may be used. In general the molar ratio of cationic lipid to non-cationic lipid in the liposome may be, for example, 1:1000, 1:100, preferably, between 2:1 to 1:10, more preferably in the range between 1:1 to 1:2.5 and most preferably 1:1 (ratio of mole amount cationic lipid to mole amount non-cationic lipid, e.g., DPPC). A wide variety of lipids may comprise the non-cationic lipid when cationic lipid is used to construct the microsphere. Preferably, this non-cationic lipid is dipalmitoylphosphatidylcholine, dipalmitoylphosphatidylethanolamine or dioleoylphosphatidylethanolamine. In lieu of cationic lipids as described above, lipids bearing cationic polymers such as polylysine or polyarginine, as well as alkyl phosphonates, alkyl phosphinates, and alkyl phosphites, may also be used to construct the microspheres.

In at least one exemplary embodiment, more preferred lipids can be phospholipids, preferably DPPC, DPPE, DPPA and DSPC, and most preferably DSPC.

In addition, examples of saturated and unsaturated fatty acids that may be used to prepare the stabilized microspheres used in the present invention, in the form of gas and gaseous precursor filled mixed micelles, may include molecules that may contain preferably between 12 carbon atoms and 22 carbon atoms in either linear or branched form. Hydrocarbon groups consisting of isoprenoid units and/or prenyl groups can be used as well. Examples of saturated fatty acids that are suitable include, but are not limited to, auric, myristic, palmitic, and stearic acids; examples of unsaturated fatty acids that may be used are, but are not limited to, lauroleic, physeteric, myristoleic, palmitoleic, petroselinic, and oleic acids; examples of branched fatty acids that may be used are, but are not limited to, isolauric, isomyristic, isopalmitic, and isostearic acids. In addition, to the saturated and unsaturated groups, gas and gaseous precursor filled mixed micelles can also be composed of 5 carbon isoprenoid and prenyl groups.

The biocompatible polymers useful as stabilizing compounds for preparing the gas and gaseous precursor filled microspheres used in the present invention can be of either natural, semi-synthetic or synthetic origin. As used herein, the term polymer denotes a compound comprised of two or more repeating monomeric units, and preferably 10 or more repeating monomeric units. The term semi-synthetic polymer, as employed herein, denotes a natural polymer that has been chemically modified in some fashion. Exemplary natural polymers suitable for use in the present invention include naturally occurring polysaccharides. Such polysaccharides include, for example, arabinans, fructans, fucans, galactans, galacturonans, glucans, mannans, xylans (such as, for example, inulin), levan, fucoidan, carrageenan, galatocarolose, pectic acid, pectin, amylose, pullulan, glycogen, amylopectin, cellulose, dextran, pustulan, chitin, agarose, keratan, chondroitan, dermatan, hyaluronic acid, alginic acid, xanthan gum, starch and various other natural homopolymer or heteropolymers such as those containing one or more of the following aldoses, ketoses, acids or amines: erythrose, threose, ribose, arabinose, xylose, lyxose, allose, altrose, glucose, mallllose, gulose, idose, galactose, talose, erythrulose, ribulose, xylulose, psicose, fructose, sorbose, tagatose, mannitol, sorbitol, lactose, sucrose, trehalose, maltose, cellobiose, glycine, serine, threonine, cysteine, tyrosine, asparagine, glutamine, aspartic acid, glutamic acid, lysine, arginine, histidine, glucuronic acid, gluconic acid, glucaric acid, galacturonic acid, mannuronic acid, glucosamine, galactosamine, and neuraminic acid, and naturally occurring derivatives thereof. Exemplary semi-synthetic polymers include carboxymethylcellulose, hydroxymethylcellulose, hydroxypropylmethylcellulose, methylcellulose, and methoxycellulose. Exemplary synthetic polymers suitable for use in the present invention include polyethylenes (such as, for example, polyethylene glycol, polyoxyethylene, and polyethylene terephthlate), polypropylenes (such as, for example, polypropylene glycol), polyurethanes (such as, for example, polyvinylalcohol (PVA), polyvinylchloride and polyvinylpyrrolidone), polyamides including nylon, polystyrene, polylactic acids, fluorinated hydrocarbons, fluorinated carbons (such as, for example, polytetrafluoroethylene), and polymethylmethacrylate, and derivatives thereof. Methods for the preparation of such polymer-based microspheres will be readily apparent to those skilled in the art, once armed with the present disclosure, when the present disclosure is coupled with information known in the art, such as that described and referred to in Unger, U.S. Pat. No. 5,205,290, the disclosures of which are hereby incorporated herein by reference, in their entirety.

One exemplary method of producing oxygen microbubbles can be produced by mixing lipids at a 9:1 molar ratio of distearoyl phosphatidylcholine (DSPC) to poly(ethylene glycol)-40 stearate (PEG40S) in saline and sonicated at low power to create the small, unilamellar liposomes. O2 and liposomes (5 mg/mL) are then combined in the reaction chamber, where a high-power, ½-inch diameter, 20-kHz sonicator tip emulsifies the oxygen gas into micrometer-scale spheres around which phospholipid adsorbs from vesicles and micelles and self-assembles into a highly condensed (solid) monolayer coating. OMBs can be separated from macroscopic foam in a subsequent flotation container and collected in syringes and centrifuged (500 g for 3 min) to form concentrated OMBs. The sonication chamber and container can be jacketed with circulating coolant to maintain a constant temperature of 20° C.

A desired OMB size distribution can be varied by choosing different residence times in the flotation container (e.g., 153 min for a 10-μm diameter cut-off; 38 min for a 20-μm diameter cut-off). Size distribution can be measured, for example, by electrical capacitance, light extinction/scattering, flow cytometry scatter, and optical microscopy. Alternatively, size selection may be unnecessary and may be removed from the process. OMB volume fraction is measured, for example, by gravimetric analysis and varied from 20-90 vol % by dilution with saline. Microbubble size and concentration is measured over time to investigate coalescence, Ostwald ripening and stability in storage.

The present disclosure also expressly incorporates by reference herein the disclosure of U.S. Pat. No. 8,481,077 entitled "Microbubbles and Methods for Oxygen Delivery" to Kheir et al, filed Feb. 22, 2012; U.S. Pat. No. 10,058,837 entitled "Systems, methods, and devices for production of gas-filled microbubbles" to Borden et al, filed Aug. 26, 2010; and U.S. Pat. No. 10,124,126 entitled "Systems and methods for ventilation through a body cavity" to Borden et al, filed Apr. 18, 2014. The entire disclosure of each of the publications, patent documents, and other references referred to herein is incorporated herein by reference in its entirety for all purposes to the same extent as if each individual source were individually denoted as being incorporated by reference.

Equivalents

The invention may be embodied in other specific forms without departing from the spirit or essential characteristics thereof. The foregoing embodiments are therefore to be considered in all respects illustrative rather than limiting on the invention described herein. Scope of the invention is thus intended to include all changes that come within the meaning and range of equivalency of the descriptions provided herein.

General

Many of the aspects and advantages of the present invention may be more clearly understood and appreciated by reference to the accompanying drawings. The accompanying drawings are incorporated herein and form a part of the specification, illustrating embodiments of the present invention and together with the description, disclose the principles of the invention.

Although the foregoing invention has been described in some detail by way of illustration and example for purposes of clarity of understanding, it will be readily apparent to those of ordinary skill in the art in light of the teachings of this invention that certain changes and modifications may be made thereto without departing from the spirit or scope of the disclosure herein.

The various headings and titles used herein are for the convenience of the reader, and should not be construed to limit or constrain any of the features or disclosures thereunder to a specific embodiment or embodiments. It should be understood that various exemplary embodiments could incorporate numerous combinations of the various advantages and/or features described, all manner of combinations of which are contemplated and expressly incorporated hereunder.

The use of the terms "a" and "an" and "the" and similar referents in the context of describing the invention are to be construed to cover both the singular and the plural, unless otherwise indicated herein or clearly contradicted by context. The terms "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., i.e., "such as") provided herein, is intended merely to better illuminate the invention and does not pose a limitation on the scope of the invention unless otherwise claimed. No language in the specification should be construed as indicating any non-claimed element as essential to the practice of the invention.

The invention claimed is:

1. A method of protecting a flowable microbubble composition from contamination or damage prior to dispensing or use in a patient, comprising:

placing the flowable microbubble composition within a first flexible and sealable enclosure, the first flexible and sealable enclosure including a substantially sterile first interior space;

inserting and suspending the first flexible and sealable enclosure completely within a second interior space of a second rigid and sealable enclosure and closing the second rigid and sealable enclosure to fully encapsulate the first flexible and sealable enclosure within the second interior space, wherein the second interior space comprises a plurality of interior walls and substantially all of the first flexible and sealable enclosure is spaced apart from the plurality of interior walls of the interior space;

maintaining the second rigid and sealable enclosure in a closed condition until at least a portion of the flowable microbubble composition is to be utilized for dispensing or use in the patient.

2. The method of protecting a flowable microbubble composition from contamination or damage prior to dispensing or use in a patient of claim 1, wherein the second interior space is in a substantially sterile condition before insertion of the first flexible and sealable enclosure.

3. The method of protecting a flowable microbubble composition from contamination or damage prior to dispensing or use in a patient of claim 2, wherein the second interior space remains in the substantially sterile condition after insertion of the first flexible and sealable enclosure.

4. The method of protecting a flowable microbubble composition from contamination or damage prior to dispensing or use in a patient of claim 1, wherein the step of placing the flowable microbubble composition within a first flexible and sealable enclosure occurs prior to the step of inserting and suspending the first flexible and sealable enclosure completely within the second interior space of the second rigid and sealable enclosure.

5. The method of protecting a flowable microbubble composition from contamination or damage prior to dispensing or use in a patient of claim 1, wherein the step of inserting and suspending the first flexible and sealable enclosure completely within a second interior space of the second rigid and sealable enclosure comprises placing a vibration dampening mount between the first flexible and sealable enclosure and the second rigid and sealable enclosure.

6. The method of protecting a flowable microbubble composition from contamination or damage prior to dispensing or use in a patient of claim 1, wherein the step of inserting and suspending the first flexible and sealable enclosure completely within a second interior space of the second rigid and sealable enclosure comprises engaging a flexible link between the first flexible and sealable enclosure and the second rigid and sealable enclosure.

7. The method of protecting a flowable microbubble composition from contamination or damage prior to dispensing or use in a patient of claim 1, wherein the step of closing the second rigid and sealable enclosure comprises securing a removable lid or cap to an opening of the second rigid and sealable enclosure.

8. The method of protecting a flowable microbubble composition from contamination or damage prior to dispensing or use in a patient of claim 1, wherein a closure lid which closes the second rigid and sealable enclosure engages with the second rigid and sealable enclosure to create an airtight seal.

9. The method of protecting a flowable microbubble composition from contamination or damage prior to dispensing or use in a patient of claim 1, wherein the second rigid and sealable enclosure further comprises an insulating container.

10. The method of protecting a flowable microbubble composition from contamination or damage prior to dispensing or use in a patient of claim 8, further comprising the steps of:

slowly equalizing an air pressure within the second interior space with an atmospheric pressure located outside of the second rigid and sealable enclosure over a period of at least 2 seconds; and opening a closure lid which was previously used to close the second rigid and sealable enclosure.

11. A container for protecting a flowable microbubble composition from contamination or damage prior to dispensing, comprising:

a first flexible and sealable enclosure having at least one enclosure wall and a mounting structure positioned near a first end of the enclosure, the first flexible and sealable enclosure having a substantially sterile first interior space, the flowable microbubble composition contained within the substantially sterile first interior space;

a second rigid and sealable enclosure having a second interior space, the second interior space comprising an opening and a plurality of interior walls with at least one interior mounting point, the opening and second interior space sized and configured to accommodate the first flexible and sealable enclosure and flowable microbubble composition through the opening and within the second interior space without the at least one enclosure wall contacting the plurality of interior walls within the second interior space;

wherein when the first flexible and sealable enclosure is placed within the second interior space and a closure top is engaged with the second rigid and sealable enclosure to close the opening, the mounting structure engages with the at least one interior mounting point to suspend the first flexible and sealable enclosure within the second rigid and sealable enclosure and prevent contact between the at least one enclosure wall and the plurality of interior walls within the second interior space; and the second rigid and sealable enclosure insulates the first flexible and sealable enclosure from exterior impacts and vibrations which contact the second rigid and sealable enclosure.

12. The container of claim 11, wherein the engagement between the mounting structure and the at least one interior mounting point comprises a vibration dampening assembly.

13. The container of claim 11, further comprising a first dispensing port extending through at least a portion of the at least one enclosure wall of the first flexible and sealable enclosure.

14. The container of claim 11, further comprising an external dispensing port extending through at least one of the plurality of interior walls of the second rigid and sealable enclosure.

15. The container of claim 14, further comprising a flexible tube extending between a dispensing port extending through at least a portion of the at least one enclosure wall of the first flexible and the external dispensing port.

16. The container of claim 11, wherein the second rigid and sealable enclosure and closure top engage in an airtight sealing arrangement.

17. The container of claim 11, wherein the first flexible and sealable enclosure can be completely removed from the second rigid and sealable enclosure.

18. The container of claim 11, further comprising a first dispensing port extending through at least a portion of the at least one enclosure wall of the first flexible and sealable enclosure, wherein when the first dispending port is opened and the first flexible and sealable enclosure is compressed at least a portion of the flowable microbubble composition exits the first flexible and sealable enclosure through the first dispensing port.

19. The container of claim 14, further comprising a flexible tube extending between a dispensing port extending through at least a portion of the at least one enclosure wall of the first flexible and the external dispensing port, and a compression plunger extending at least partially through the closure top.

20. The container of claim 19, wherein when the external dispensing port is opened and the plunger is depressed towards the first flexible and sealable enclosure, at least a portion of the flowable microbubble composition within the first flexible and sealable enclosure exits the second rigid and sealable enclosure through the external dispensing port.

* * * * *